United States Patent [19]

Graf et al.

[11] 4,051,807

[45] Oct. 4, 1977

[54] APPARATUS FOR APPLYING PREPARATION AGENTS TO A BUNDLE OF FILAMENTS

[75] Inventors: Felix Graf, Winterthur; Louis Moser, Hettlingen, both of Switzerland

[73] Assignee: Rieter Machine Works Ltd., Winterthur, Switzerland

[21] Appl. No.: 669,466

[22] Filed: Mar. 22, 1976

[30] Foreign Application Priority Data

Apr. 3, 1975 Switzerland ..... 4217/75

[51] Int. Cl.[2] ..... B05C 3/00; B05C 3/12

[52] U.S. Cl. ..... 118/401; 118/410; 118/420; 118/DIG. 19

[58] Field of Search ..... 118/401, 410, 411, 412, 118/420, DIG. 19, DIG. 22, 334, 325; 139/93; 242/157 R; 68/200

[56] References Cited

U.S. PATENT DOCUMENTS

| | | | |
|---|---|---|---|
| 1,934,796 | 11/1933 | Friederich | 118/401 |
| 2,325,129 | 7/1943 | Hardy | 118/401 |
| 2,708,813 | 5/1955 | Bourgeaux | 118/DIG. 19 |
| 2,875,728 | 3/1959 | Kasak | 118/410 |
| 2,928,716 | 3/1960 | Whitehurst et al. | 118/401 X |
| 2,963,739 | 12/1960 | Whitehurst et al. | 118/401 X |
| 2,976,177 | 3/1961 | Warthen | 118/420 X |
| 2,977,929 | 4/1961 | Whitehurst et al. | 118/401 |
| 3,049,151 | 8/1962 | McFetters | 139/93 |
| 3,336,901 | 8/1967 | Dauchert | 118/420 X |

FOREIGN PATENT DOCUMENTS

| | | | |
|---|---|---|---|
| 1,270,912 | 6/1968 | Germany | 242/157 R |
| 6,818,340 | 6/1970 | Netherlands | 118/410 |

*Primary Examiner*—James Kee Chi

[57] ABSTRACT

Apparatus for applying preparation agents onto a large filament bundle passing through substantially vertically, comprising an applicator head with a slit for applying the preparation agent and at least one guide edge for guiding the filament bundle. A supply duct supplies the preparation agent to the slit. The applicator head consists of at least two opposite surfaces forming the slit and the guide edge, which surfaces are provided at least in the slit with a roughness assisting the distribution of the agent in the slit.

6 Claims, 3 Drawing Figures

APPARATUS FOR APPLYING PREPARATION AGENTS TO A BUNDLE OF FILAMENTS

BACKGROUND OF THE INVENTION

The present invention relates to a new and improved construction of apparatus for applying preparation agents onto a bundle of filaments which is of the type comprising an applicator head with a slit for applying the preparation agent and a guide edge for guiding the filament bundle and a supply duct for supplying the preparation agent to the slit. Such devices are used mainly in the textile industry for coating an endless filament.

The purpose of a preparating device is to apply the preparation agents at an even supply rate to the filament bundle and to transfer it evenly distributed to the filament bundle. Devices for applying preparation agents to filament bundles are known as such.

One such type of device consists, for instance, of an applicator head containing a reservoir for the preparation agent. In this arrangement there is provided at a guide surface formed by the upper wall of the reservoir and thus extending upwardly a slit which extends over the width of the guide surface. The slit serves for applying the preparation agents to a filament bundle guided in substantially horizontal direction across the guide surface. The applicator is provided with a preparation agent-supply device at its lower portion. The preparation agent, in this arrangement, is applied from the reservoir to the filament bundle with a very low pressure approaching zero.

The disadvantage of such type device is seen in the imprecision of the applied quantities of preparation agent due to the practically direct connection between the preparation agent reservoir and the filament guiding surface. In this arrangement no buffer zone exists between the preparation agent reserve or supply and the filament bundle, so that even the smallest pressure variations in the preparation agent supply directly act upon the preparation agent application.

Due to the necessarily horizontal arrangement of the filament bundle on the guide surface a further disadvantage is that at high thread or filament speeds of, for instance, in excess of 2,000 meters per minute, a high hydrodynamic friction between the wetted filament bundle and the guide surface is generated in such manner that there can be caused undesirable additional thread tension at the thread winding position.

Furthermore, the horizontal guide arrangement in a substantially vertical thread path necessitates two thread deflections which is technically and economically complicated and thus constitutes a disadvantage.

Also known are nozzles of round cross-section made of ceramic material provided with a fine bore in axial direction for supplying the preparation agent and with a wedge-shaped slit coinciding with the bore for guiding the filament bundle. The bore in this arrangement merges into the slit at the narrowed part of the wedge which guides the thread.

The disadvantage of a nozzle of such type resides in the fact that the thread is too narrowly bundled at the preparation agent application point in such manner that there is not insured for any even distribution of the preparation agent across the whole cross-section of the filament bundle.

SUMMARY OF THE INVENTION

Thus, it is a primary object of the present invention to eliminate the disadvantages mentioned above and to create an apparatus with which preparation agent can be metered exactly and be distributed evenly onto a large flat filament bundle.

Now in order to implement these and still further objects of the invention, which will become apparent as the description proceeds, the inventive apparatus for applying preparation agents to a large filament bundle passing through substantially vertically comprises an applicator head with a slit for applying the preparation agent and with at least one guide edge for guiding the filament bundle and with a supply duct for supplying the preparation agent to the slit. The applicator head consists of at least two opposite surfaces forming the slit and the guide edge, which surfaces are provided at least in the slit with a roughness assisting the distribution of the liquid in the slit.

Furthermore, the height of the slit can be adjusted by an exchangeable third intermediate member inserted between the surfaces.

The roughness can be of a value ranging from Ra=1.8 $\mu$m to Ra=3.6 $\mu$m.

Also the surfaces forming the slit can be roughened by sandblasting or by the plasma coating method known as such.

The slit can be of a height of 0.15 millimeters.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE INVENTION

Figure 1:
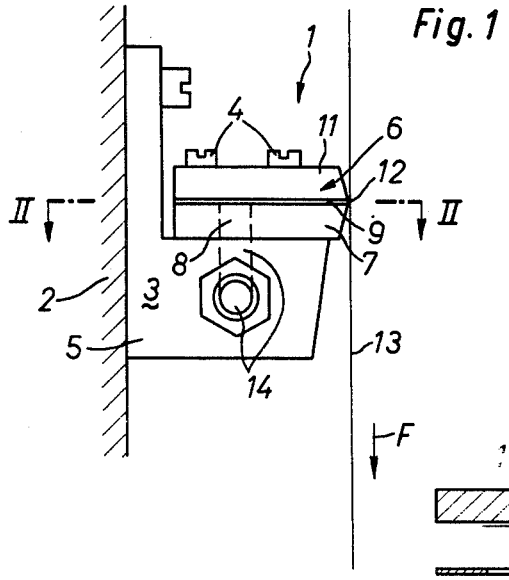
FIG. 1 illustrates in side view an apparatus for applying preparation agents.
Figure 3:
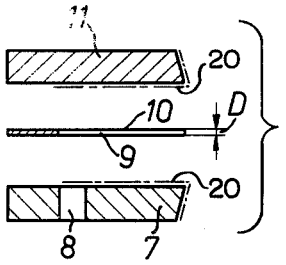
FIG. 3 illustrates a detail of the apparatus according to FIG. 1 in cross-section along the arrows III-III of FIG. 2, with an enlarged distance or spacing between the plates.
Figure 2:
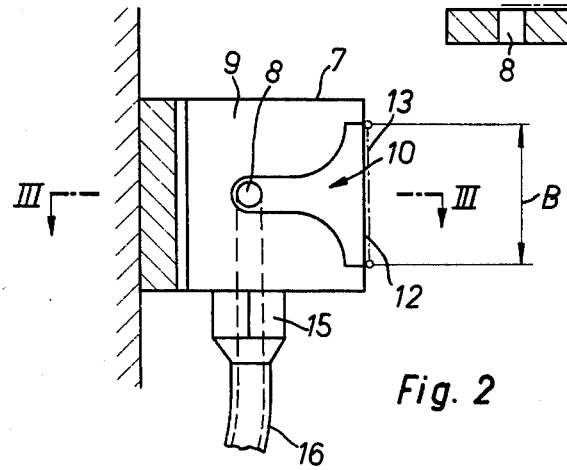
FIG. 2 illustrates the apparatus according to FIG. 1 in top sectional view corresponding to the arrows and II-II.

Referring now to the drawings, there is illustrated in FIGS. 1 to 3 an exemplary embodiment of an apparatus 1 for applying preparation agents which comprises a support member 3 mounted upon a fixed base 2 and an applicator head 6 fixed by screws 4 or other suitable means on a foot or base portion 5 of the support member 3. The applicator head 6 consists of a lower member 7 with a supply duct 8, an intermediate member 9 with a recess 10 (FIGS. 2 and 3) and an upper member 11.

The recess or cutout 10 forms a connecting slit from the supply duct 8 to a guide edge 12 at which there is guided a filament bundle 13 of a width B. The filament bundle 13 consists of a series of individual filaments arranged side by side, which in FIG. 1 is indicated by the individual filament and in FIG. 2 is indicated schematically by the dash-dotted line interconnecting the two small circles representing filament cross-sections. The height of the slit corresponds to the thickness D of the intermediate member 9 which may be interchangeable to adapt the slit height to requirements.

In the foot or base portion 5 a substantially L-shaped duct 14 connects the duct 8 with a connecting nipple 15 of known type which, in turn, is connected via a tube 16 with a suitable metering device (not shown).

The upper member 11 and the lower member 7 are provided at their respective surface facing the intermediate member 9 and the filament bundle 13 with an optimum roughness value of Ra=3.0 μm. These roughened surfaces have been generally indicated by reference character 20 in FIG. 3. Tests have proven that the useful surface roughness values range from Ra=1.8 μm to Ra=3.6 μm. The roughness is used for generating a better distribution of the liquid in the slit.

The surface roughness can be created by sandblasting or by a plasma coating method. Experiments have demonstrated that plasma coated surfaces generate a somewhat better liquid distribution effect than sandblasted surfaces.

The thickness D of the intermediate member 9 is chosen according to the viscosity, the supply rate and the supply pressure which is applicable as well as the capillary effect, and most simply is determined by trial and error from case to case.

Using a slit height D of, for instance 0.15 millimeters and a supply rate of 3.5 $cm^3$ per minute, preparation liquids with viscosities ranging from $\eta = 2$ to 31 centipoise at room temperature were distributed as described and applied to the filament bundle 13.

The recess 10 can be formed also without using an intermediate member if in the lower member 7 and/or in the upper member 11 corresponding recesses are provided. The advantage of the present invention resides in the fact that the preparation agent supplied into the applicator head is evenly distributed over the full slit width B, on the one hand, substantially owing to the braking roughness, and on the other hand, due to the finely distributed capillary action because of the roughness, so that the thus distributed preparation agent is taken-up evenly by the filament bundle 13.

While there are shown and described present preferred embodiments of the invention, it is to be distinctly understood that the invention is not limited thereto, but may be otherwise variously embodied and practiced within the scope of the following claims. ACCORDINGLY,

WHAT IS CLAIMED IS:

1. An apparatus for applying preparation agents onto a large filament bundle passing through in a substantially vertical direction, comprising an applicator head provided with a slit for applying the preparation agent and at least one guide edge for guiding the filament bundle, a supply duct for supplying the preparation agent to the slit, the applicator head embodying at least two oppositely situated surfaces forming the slit and the guide edge, said surfaces are provided at least at the region of the slit with a roughness assisting in the distribution of the preparation agent in the slit.

2. The apparatus as defined in claim 1, wherein the height of the slit is adaptable by an interchangeable intermediate member insertable between the surfaces.

3. The apparatus as defined in claim 1, wherein the surfaces of the slit comprise sandblast-roughened surfaces.

4. The apparatus as defined in claim 1, wherein the surfaces of the slit comprise plasma coated-roughened surfaces.

5. The apparatus as defined in claim 1, wherein the surfaces have a roughness value which ranges from Ra=1.8 μm to 3.6 μm.

6. The apparatus as defined in claim 1, wherein the slit possesses a height of approximately 0.15 millimeters.

* * * * *